US006705382B1

(12) United States Patent
Johansen

(10) Patent No.: US 6,705,382 B1
(45) Date of Patent: Mar. 16, 2004

(54) METHOD OF IMPROVING THE MOULD QUALITY OF MOULD-FORMING MACHINE

(75) Inventor: Jan Bechmann Johansen, Humlebæk (DK)

(73) Assignee: Disa Industries A/S, Herlev (DK)

( * ) Notice: Subject to any disclaimer, the term of this patent is extended or adjusted under 35 U.S.C. 154(b) by 0 days.

(21) Appl. No.: 10/149,914

(22) PCT Filed: Dec. 27, 1999

(86) PCT No.: PCT/DK99/00737

§ 371 (c)(1),
(2), (4) Date: Jun. 13, 2002

(87) PCT Pub. No.: WO01/47654

PCT Pub. Date: Jul. 5, 2001

(51) Int. Cl.[7] ..... B22C 15/24; B22C 25/00

(52) U.S. Cl. ..... 164/18; 164/200; 164/323

(58) Field of Search ..... 164/18–21, 27, 164/29, 200–202, 322–324

(56) References Cited

U.S. PATENT DOCUMENTS 5,355,929 A * 10/1994 Sorensen ..... 164/20

* cited by examiner

*Primary Examiner*—Kuang Y. Lin
(74) *Attorney, Agent, or Firm*—Larson & Taylor PLC

(57) ABSTRACT

The method of improving the mould quality of a mould-forming machine comprising at least one moulding chamber with oppositely positioned and movable squeeze plates, in which the mould-forming process comprises the steps of a) filling the at least one moulding chamber with compressible mould material, b) pressing the mould material between the squeeze plates, c) opening the moulding chambers(s) by moving at least one of the squeeze plates, d) removing the produced mould or mould parts from the moulding chamber (s) and e) reclosing the moulding chambers(s) by moving at least one of the squeeze plates, ready for a new cycle starting from step (a), by moving at least one squeeze plate in a direction reducing the volume of the moulding chambers(s) during at least part of the filling step a), an improved filling of mould cavities is achieved, which compensates for the reduced filling velocity during start-up of the filling.

7 Claims, 2 Drawing Sheets

METHOD OF IMPROVING THE MOULD QUALITY OF MOULD-FORMING MACHINE

TECHNICAL FIELD

The present invention relates to a method of improving the mould quality of a mould-forming machine, such as a string-moulding apparatus, a flaskless mould-forming machine or the like, in which the mould-forming process comprises the steps of filling a moulding chamber with compressible mould material, e.g. clay-bonded green sand, pressing the mould material between two squeeze plates, thus forming the mould or mould parts (cope and drag), the moulding cavities being provided in the produced mould or mould parts by means of pattern plates. After pressing the mould material, the moulding chamber is opened by moving at least one of the squeeze plates and the produced mould or mould parts are removed from the moulding chamber. Thereafter, the moulding chamber is reclosed and ready for a new cycle.

BACKGROUND ART

A method of this general kind is known from U.S. Pat. No. 5,647,424. According to this method, the squeeze plates carry out a number of sequential movements in order to produce a mould. The moulding process comprises the steps of: Filling the moulding chamber with compressible mould material, e.g. clay-bonded green sand, pressing the mould material between two squeeze plates, thus forming the mould, retracting one of the squeeze plates for opening the moulding chamber and removing the produced mould from the moulding chamber and moving the squeeze plates back to their respective starting positions, whereafter a new cycle begins.

Document EP-0,468,355 discloses a similar method, but used in a moulding machine with a cope-flask, a pattern plate and a drag flask, for producing flaskless moulds, i.e. drag and cope.

In the above methods, the filling of the moulding chamber is started after closing the moulding chamber with the squeeze plates, the squeeze plates being stationary during the filling step, and the squeezing is started after the filling has been completed. The filling of the moulding chamber is performed by exposing the sand hopper to pressure or by evacuating the moulding chamber, thereby providing a pressure difference between the sand hopper and the moulding chamber, blowing the mould material into the moulding chamber. When starting the filling of the moulding chamber, the velocity of the mould material increases during the initial filling and accordingly, the filling of the part of the moulding chamber opposite of the filling opening will be less effective than the filling of the following parts of the moulding chamber. Thus, a difference in quality of the mould is experienced between the parts filled first and the parts filled later during the filling procedure. This may result in differences in the degrees of hardness of the mould surfaces produced in the different parts of the moulding chamber and differences in the effectiveness of filling recesses in pattern plates in the moulding chamber. These differences in hardness of the mould from top to bottom result in reduced dimensional precision and surface properties.

DISCLOSURE OF THE INVENTION

It is the object of the present invention to provide a method of improving the mould quality of a mould-forming machine of the kind referred to above, which alleviates the above-mentioned problems, thus resulting in a higher quality of the produced moulds. This object is achieved with a method of said kind, by the movement of at least one squeeze plate in a direction reducing the volume of moulding chamber during at least part of the filling step which results in an improved filling of recesses in the pattern plates, especially in the parts of the moulding chamber opposite the infeed opening(s).

According to a preferred embodiment of the invention, the movement of least one squeeze plate in said direction is performed during the initial part of the filling step. This will result in a pre-compression of only the first filled part of the moulding chamber, which is filled with mould material at a lower velocity than the rest of the moulding chamber.

In a further preferred embodiment, the movement of at least one squeeze plate is performed in continuation of the closing movement of said squeeze plate, whereby it will not be necessary to bring said squeeze plate to a halt before starting the filling operation.

In accordance with a further aspect of the invention, the movement of the squeeze plate during the filling step is performed without stopping but with varied, controlled speed during the filling step and the movement is continued into the pressing step.

Further preferred embodiments are revealed hereinafter.

BRIEF DESCRIPTION OF THE DRAWINGS

In the following detailed part of the description, the invention will be explained in more detail with reference to the exemplary embodiments of the method according to the invention shown in the drawings, in which.

DESCRIPTION OF THE PREFERRED EMBODIMENTS

Figure 1:
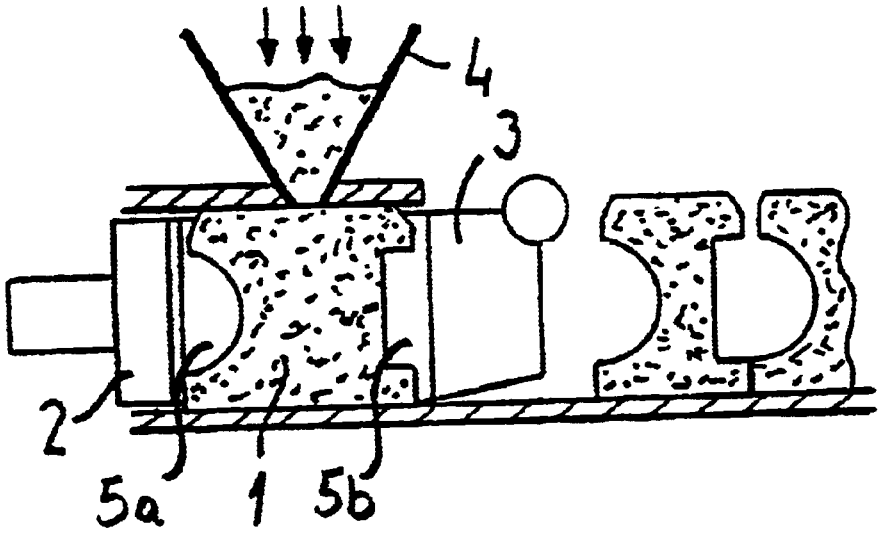
FIG. 1 shows a string-moulding apparatus in the filling position.
Figure 2:
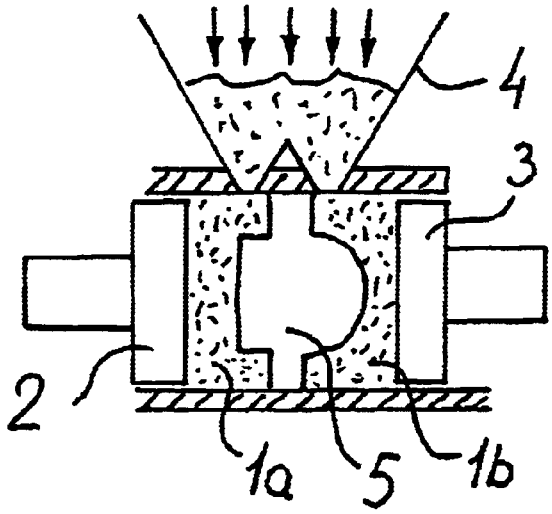
FIG. 2 shows a flaskless mould-forming machine in the filling position.

In FIGS. 1 and 2, two mould-forming machines are shown in the filling position. In FIG. 1, the mould-forming machine is a string-moulding apparatus comprising a moulding chamber 1, the one end of which is closed by a squeeze plate 2 carrying a pattern 5*a*, and the other end being closed by a pivoted squeeze plate 3 carrying a pattern 5*b*. In the filling position shown in FIG. 1, the moulding chamber 1 is filled with compressible mould material from a hopper 4.

FIG. 2 illustrates a flaskless mould-forming machine in the filling position. In this apparatus, the moulding chamber 1*a*, 1*b* is divided into two parts by a pattern 5 and the moulding chamber is closed at one end by a squeeze plate 2 and at the other end by a squeeze plate 3. The moulding chamber 1*a*, 1*b* is filled with compressible mould material from a hopper 4 through separate openings into the two parts 1*a*, 1*b* of the moulding chamber.

Figures 3, 4A, 4B:
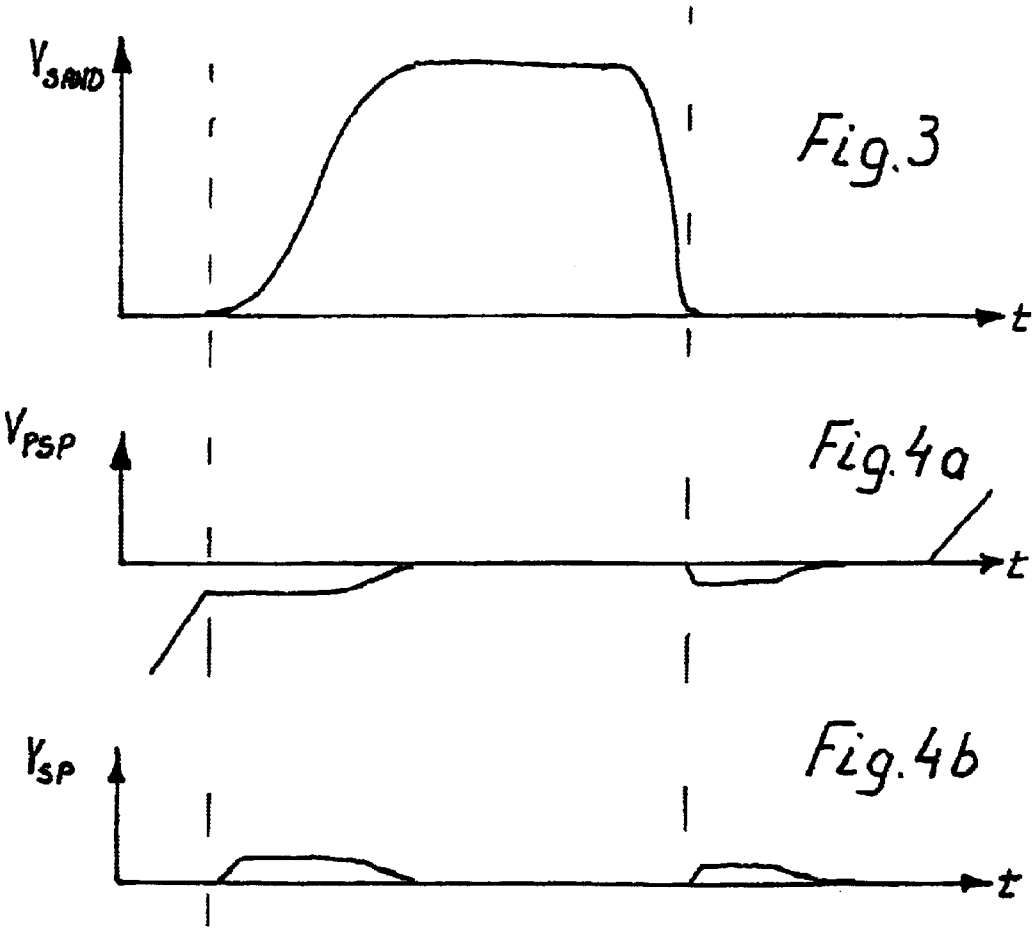
FIG. 3 shows a plot of the velocity of the sand ($V_{SAND}$) versus time (t), i.e. a velocity profile, and FIGS. 4*a* and *b* respectively shows plots of the speed of the pivotable squeeze plate ($V_{PSP}$) and of the squeeze plate ($V_{SP}$) versus time (t), i.e. speed profiles, according to a preferred embodiment of the invention.

The velocity profile shown in FIG. 3 illustrates that the sand velocity during initial filling is relatively low, which results in a less efficient filling of recesses in the bottom part of the moulding chamber, as e.g. illustrated in FIGS. 1 and 2.

FIGS. 4*a* and 4*b* show how the present method compensates for this reduced efficiency of filling recesses, by moving the pivotal squeeze plate 3 and the squeeze plate 2, respectively, during part of the filling step, or during the whole filling step, whereby the mould material will be pre compressed in the parts of the moulding chamber already filled with mould material. This results in an improved filling of these recesses, and the speed profile for the squeeze plate 2, 3 can be optimized for proper filling of recesses in the pattern plates 5, 5*a*, 5*b* by experimentation.

The optimum speed profile will naturally be dependent on the used pattern plates and accordingly, said optimization will have to be performed for each new type of form being produced.

In order to be able to control the movements of the squeeze plates, the hydraulic system of the mould-forming machine will naturally have to comprise means for controlling the velocities of the squeeze plates such as variable displacement hydraulic pumps, e.g. swash plate pumps having a swash plate serving as a displacement volume varying member.

As a supplement to solving the problem of insufficient filling of recesses in the pattern plates, the invention also provides a possibility of reducing the cycle time for production of moulds due to the fact that an overlap is provided between the step of closing the moulding chamber and the step of filling the moulding chamber and possibly between the step of filling the moulding chamber and the step of squeezing the mould material in said moulding chamber.

I claim:

1. Method of improving the mould quality of a mould-forming machine comprising at least one moulding chamber with oppositely positioned and movable squeeze plates, in which the mould-forming process comprises the steps of a) filling the at least one moulding chamber with compressible mould material, b) pressing the mould material between the squeeze plates, c) opening the at least one moulding chamber by moving at least one of the squeeze plates, d) removing the produced mould or mould parts from the at least one moulding chamber and e) reclosing the at least one moulding chamber by moving at least one of the squeeze plates, so as to be ready for a new cycle starting from step a), characterized by comprising the further step of:

a1) moving the at least one squeeze plate in a direction reducing the volume of the at least one moulding chamber during at least part of the filling step a).

2. Method in accordance with claim 1, characterized by step a1) comprising the step of moving the at least one squeeze plate in said direction during the initial part of the filling step a).

3. Method in accordance with claim 2, characterized by step a1) being performed in continuation of the closing movement of step e).

4. Method in accordance with claim 1, characterized by the moving of the squeeze plates during step a) being performed without stopping but with varied, controlled speed during the filling step a), and continued movement to provide the pressing in step b).

5. Method in accordance with claim 1, characterized by the moulding machine being a string-moulding machine.

6. Method in accordance with claim 1, characterized by the moulding machine being a flaskless moulding machine, producing cope and drag mould parts.

7. Method in accordance with claim 1, characterized by step a) comprising the step of filling the at least one moulding chamber with mould material by blowing said mould material into the at least one moulding chamber.

* * * * *